United States Patent [19]

Meyers et al.

[11] 4,089,458

[45] May 16, 1978

[54] BLANK FOR COMPARTMENTALIZED TRAY

[75] Inventors: George Leroy Meyers; Donald Roy Kuehl, both of Menasha, Wis.

[73] Assignee: American Can Company, Greenwich, Conn.

[21] Appl. No.: 796,183

[22] Filed: May 12, 1977

[51] Int. Cl.[2] ..... B65D 5/48; B65D 5/28

[52] U.S. Cl. ..... 229/32; 229/27; 229/42; 229/15

[58] Field of Search ..... 229/27, 28, 32, 42

[56] References Cited

U.S. PATENT DOCUMENTS

| | | | |
|---|---|---|---|
| 2,274,714 | 3/1942 | Levkoff | 229/30 |
| 2,561,504 | 7/1951 | Dwyer | 229/42 X |
| 3,434,646 | 3/1969 | Schmidt | 229/28 R X |
| 3,656,612 | 4/1972 | Sellors | 229/27 X |
| 3,829,003 | 8/1974 | Dilot | 229/27 X |
| 3,876,132 | 4/1975 | Kuchenbecker | 229/27 |

*Primary Examiner*—Davis T. Moorhead

*Attorney, Agent, or Firm*—Robert P. Auber; George P. Ziehmer; Harry C. Engstrom

[57] ABSTRACT

A unitary paperboard blank for forming a tray with point-of-use flip-up partitions. The blank has an extension flap attached to the top edge of one of the side walls along a breakaway line of weakness. The extension flap has one or more divider panels formed therein depending upon the number of compartments desired in the tray. The side wall with its attached extension flap is folded over the bottom panel and the extension flap is glued to the inside surface of the bottom panel. The side wall is then broken away from the extension flap and the tray then formed on conventional tray forming equipment.

2 Claims, 5 Drawing Figures

BLANK FOR COMPARTMENTALIZED TRAY

BACKGROUND OF THE INVENTION

This invention relates to paperboard trays and more particularly to blanks for forming a tray having one or more point-of-use flip-up partitions.

Compartmentalized trays, while are desirable for many uses, particularly for instance, in the food packaging and service industries, have never achieved their potential for one or more of the following reasons. Compartmentalized trays have typically been formed from two separately produced blanks and/or could not be set up on conventional tray forming equipment. Furthermore, trays with erected partitions cannot be nested for shipping. Accordingly, there has been a need for a paperboard tray with point-of-use flip-up partitions which can be inexpensively produced from a unitary blank that can be glued on just one surface and set up on conventional tray forming equipment.

SUMMARY OF THE INVENTION

In summary, our invention resides in the production of a unitary paperboard tray blank which need be glued on only one side and can be set up on conventional tray forming equipment to form a tray capable of being compartmentalized at the point-of-use by flipping up one or more divider panels or partitions. The blanks can be shipped flat or in the form of tapered nested trays. Furthermore, the invention may be practiced to form trays with either glued or interlocked corners and to produce straight sided trays as well as tapered trays.

The blank has an extension flap attached to the top edge of one of the side walls and is folded over the bottom panel with the side wall attached. The extension flap is glued to the bottom panel and the side wall is then lifted to break it away from the overlayed extension flap. The blank is then ready to be set up on conventional tray forming equipment.

Further objects, features and advantages of our invention will be apparent from the following detailed description taken in connection with the accompanying drawings showing a preferred embodiment for exemplification.

DETAILED DESCRIPTION OF A PREFERRED EMBODIMENT

Figure 1:
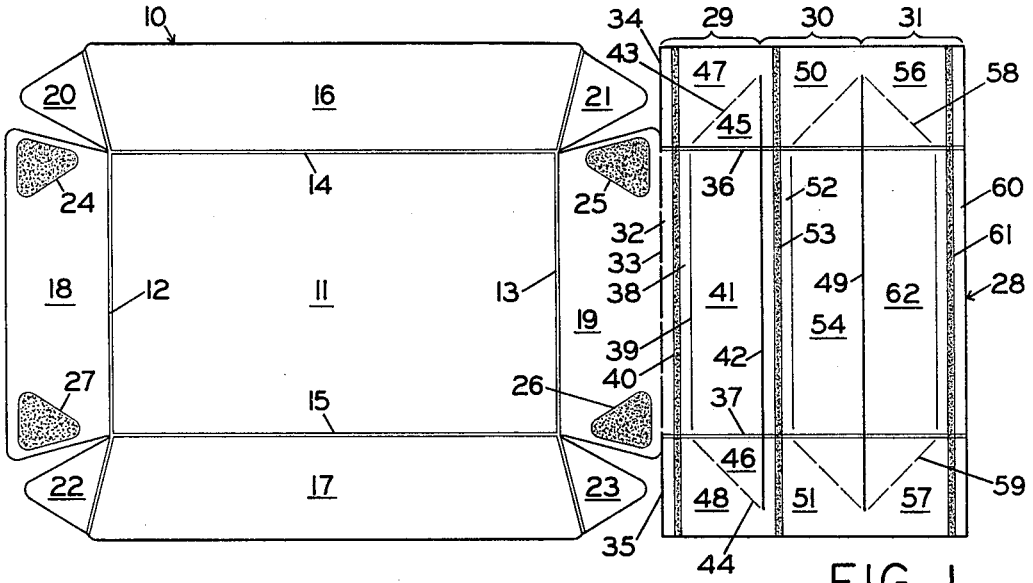
FIG. 1 is a plan view of a paperboard blank exemplifying the principles of our invention.
Figure 4:
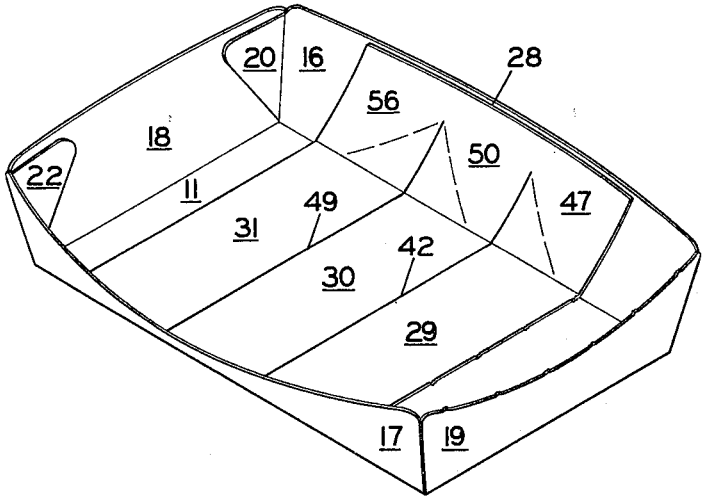
FIG. 4 is an isometric view of a tray formed from the blank shown in FIGS. 1–3 with the partitions laying down flat against the bottom panel of the tray.
Figure 5:
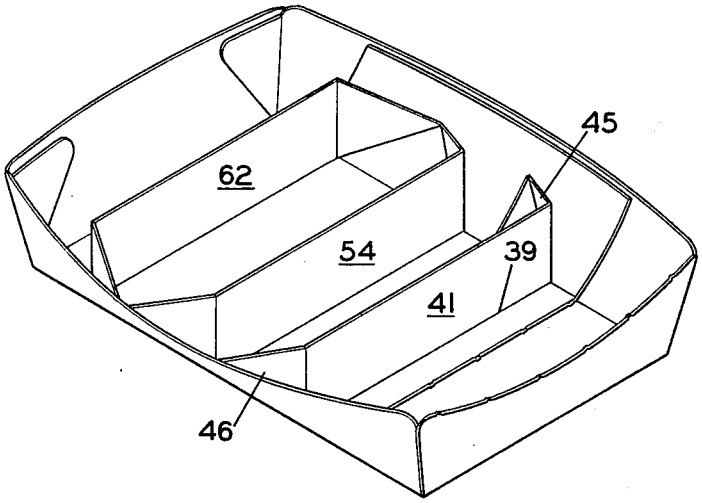
FIG. 5 is an isometric view of the tray shown in FIG. 4 with the partitions flipped up to form compartments in the tray.

Referring now more particularly to the drawings wherein like numerals refer to like parts throughout the several views, the paperboard blank 10 shown in FIG. 1 is suitably cut and scored to be folded and glued to form the partitioned or compartmentalized carton shown in FIGS. 4 and 5.

The blank 10 has a rectangular bottom panel 11 defined by first and second side score lines 12 and 13, respectively, and a pair of primary end score lines 14 and 15. The blank has a pair of end walls 16 and 17 hingedly connected along said primary end score lines, respectively. First and second side walls 18 and 19 are hingedly connected to the bottom panel 11 along the first and second side score lines 12 and 13, respectively. Four corner tabs, 20–23 are provided for connecting the end walls and side walls together. As shown in FIG. 1, glue areas 24–27 are provided for adhering the corner tabs 20–23 to the side walls 18 and 19 to form a tray body. This much of the blank is conventional for forming the well-known form of tapered tray.

The paperboard blank 10 has an extension flap 28 having three divider panels 29, 30 and 31 formed therein by cut lines 42 and 49. While three divider panels are shown for exemplification, one or any number more desired fall within the scope and spirit of the invention.

The first divider panel 29 has a main portion 32 hingedly connected to the upper edge of second side wall 19 along a breakaway line of weakness 33 and has a pair of end portions 34 and 35 connected to the main portion 32 along a secondary pair of end score lines 36 and 37, respectively. The secondary end score lines 36 and 37 are aligned with primary end score lines 14 and 15, respectively. The main portion 32 of the first divider panel 29 has an attachment section 38 which is defined therein by said pair of secondary end score lines 36 and 37 and a fold line 39 and has a partition section 41 hingedly connected to the attachment section 38 along the fold line 39. The fold line is preferrably a cut score only partially through the thickness of the board. The end portions 34 and 35 of the first divider panel have a pair of biased perforated fold lines 43 and 44 dividing the respective end portions to substantially triangular web sections 45 and 46 and end glue sections 47 and 48. The fold lines 43 and 44 are shown as perforation cut scores for exemplification. The attachment section 38 and end glue sections 47 and 48 have an adhesive strip 40 applied thereacross.

In the blank embodiment shown in FIG. 1 for exemplification, the extension flap 28 has three divider panels for forming a tray with four compartments. The second divider panel 30 is identical to divider panel 29 and is integrally attached thereto by its end glue sections 50 and 51 which are integral with the end glue sections 47 and 48, respectively, of divider panel 29. The third divider panel 31 shown is identical to divider panels 29 and 30 except that it is reversed, that is its attachment section 60 is on the right side and its partition section 62 is on the left side, and its biased perforated fold lines 58 and 59 are transverse to the biased fold lines of panels 29 and 30.

Figure 2:
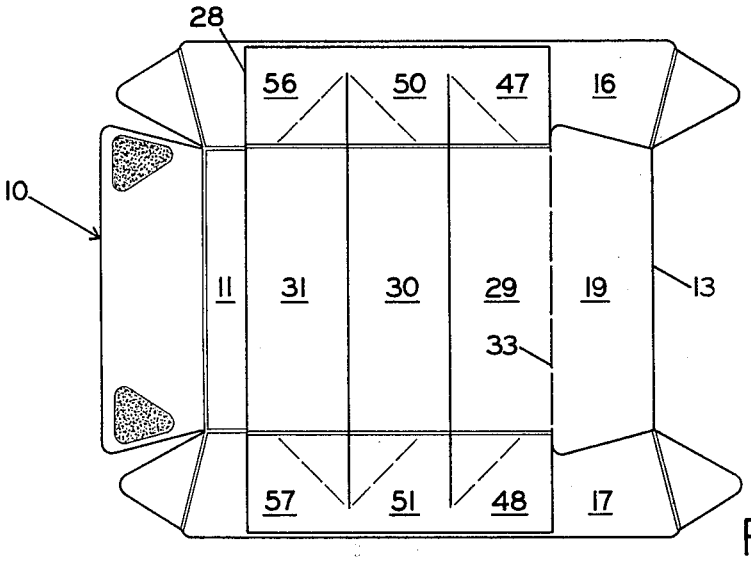
FIG. 2 is a plan view of the blank of FIG. 1 with the side wall and extension flap folded over the bottom panel.
Figure 3:
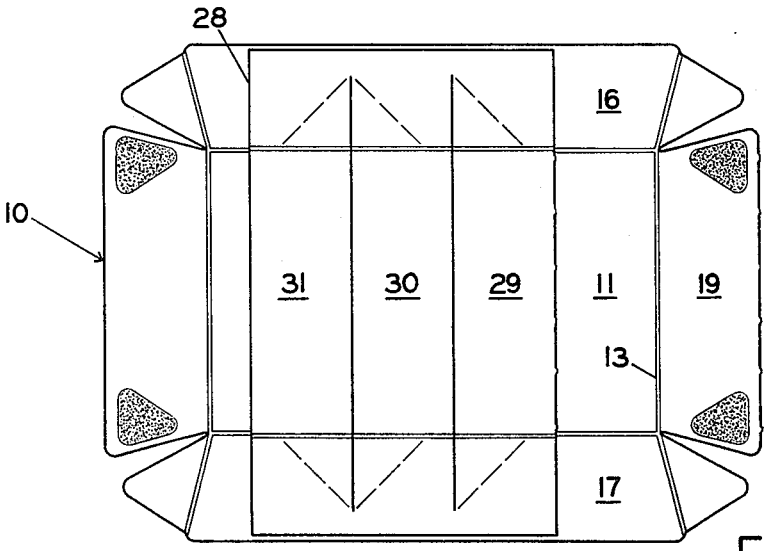
FIG. 3 is a plan view of the blank shown in FIGS. 1 and 2 with the extension flap glued to the bottom panel and the side wall broken away therefrom and folded open.

Referring now to FIGS. 1–3, during production the side wall 19 and extension flap 28 which is attached thereto are folded over about score line 13 onto bottom panel 11 as shown in FIG. 2 and the extension flap 28 is adhered to the bottom panel 11 and end wall 16 and 17 along the three glue strips 40, 53 and 61. The side wall 19 is then broken away from the adhered extension flap along tear line 33 by a spear and side wall 19 is opened as shown in FIG. 3. The blank can then be shipped in this flattened condition as shown in FIG. 3 or it can be formed into the tray form shown in FIG. 4.

The blank as shown in FIG. 3 is formed into the tray shown in FIG. 4 on conventional tray forming machinery whereby the corner tabs are adhered to the side walls 18 and 19 at the glue areas. It is also within the scope and spirit of this invention that the tray may be formed with interlocking corners rather than the glued corners shown. The tray shown in FIG. 4 with the dividers 29, 30 and 31 lying flat against the bottom panel may be shipped to the point of use in the usual nested fashion.

At the point-of-use, the tray can be compartmentalized by manually grasping the edges formed by cut lines 42 and 49 and flipping up the partition portions 41, 54 and 62 of the respective divider panels to form a four compartment tray. As shown in FIG. 5 for example, the partition portion 41 is pivoted upwardly along fold line 39 and the web sections 45 and 46 act as flexible hinges holding the partition erect.

As mentioned herein before, merely to illustrate the versatility of the carton, the divider panel 31 in FIG. 4 is shown reversed from divider panels 29 and 30 so that the partition portion 62 thereof is erected by pivoting it upwardly to the left in FIG. 5 while partition sections 41 and 54 are erected by pivoting them to the right. This may be desirable to provide a compartment of a desired size.

It should be understood that this invention is not confined to the particular construction herein illustrated and described, but embodies all such modified forms as come within the scope of the following claims.

We claim:

1. A paperboard tray blank comprising:

(a) a rectangular bottom panel defined by first and second side score lines and a pair of primary end scores lines;

(b) a pair of end walls hingedly connected to said bottom panel respectively along said primary end score lines;

(c) first and second side walls hingedly connected to said bottom panel respectively along said first and second side score lines, said second side wall having an upper edge opposite said second side score line;

(d) four corner tabs for connecting said end walls and side walls together to form a tapered tray body;

(e) a first divider panel having a main portion hingedly connected to the upper edge of said second side wall along a breakaway line of weakness and having a pair of end portions hingedly connected to said main portion along a pair of secondary end score lines which are substantially aligned respectively with said primary end score lines;

(f) the main portion of said first divider panel having an attachment section defined by said pair of secondary end score lines and a fold line and having a partition section hingedly connected to said attachment section along said fold line; and (g) the end portions of said first divider panel having a pair of biased fold lines dividing the end portions into substantially triangular web sections and end glue sections.

2. The paperboard tray blank as specified in claim 1 comprising at least one additional divider panel having a second pair of end glue sections integrally attached to the end glue sections of said first divider panel for forming a tray with at least three compartments.

* * * * *